US005347948A

United States Patent [19]

Rytand

[11] Patent Number: 5,347,948

[45] Date of Patent: Sep. 20, 1994

[54] PANELIZED FLOAT SYSTEM

[76] Inventor: David H. Rytand, P.O. Box 546, Bellevue, Wash. 98009-0546

[21] Appl. No.: 106,116

[22] Filed: Aug. 13, 1993

[51] Int. Cl.[5] ..... B63B 35/44

[52] U.S. Cl. ..... 114/263; 114/267; 405/219

[58] Field of Search ..... 405/218, 219; 114/263, 114/266, 267, 264; D12/316

[56] References Cited

U.S. PATENT DOCUMENTS

| | | | |
|---|---|---|---|
| D. 270,529 | 9/1983 | Thompson | D12/89 |
| 1,900,319 | 3/1933 | Vermeulen | 114/263 |
| 2,879,735 | 3/1959 | Pointer | 114/263 |
| 3,009,326 | 11/1961 | Williams | 405/219 |
| 3,012,533 | 12/1961 | Tellefsen | 405/219 |
| 3,073,271 | 1/1963 | Brill | 114/263 |
| 3,073,274 | 1/1963 | Lamb | 114/263 |
| 3,091,203 | 5/1963 | Usab | 114/263 |
| 3,157,144 | 11/1964 | De Jarnett | 114/263 |
| 3,179,076 | 4/1965 | Sheffield | 114/263 |
| 3,276,209 | 10/1966 | Mosdell | 114/266 |
| 3,323,479 | 6/1967 | Filak | 114/263 |
| 3,448,709 | 6/1969 | Hardwick, Jr. | 114/263 |
| 3,521,588 | 7/1970 | Atlas | 114/263 |
| 3,580,202 | 5/1971 | Thompson | 114/263 |
| 3,659,540 | 5/1972 | Toby et al. | 114/263 |
| 3,789,446 | 2/1974 | Rudelick | 114/263 |
| 3,861,340 | 1/1975 | Clingenpeei | 114/263 |
| 3,951,085 | 4/1976 | Johnson et al. | 114/263 |
| 3,977,344 | 8/1976 | Holford | 114/263 |
| 4,041,716 | 8/1977 | Thompson | 405/219 |
| 4,126,006 | 11/1978 | Lewis | 405/220 |
| 4,223,629 | 9/1980 | Dunlop | 114/263 |
| 4,252,470 | 2/1981 | Sluys | 114/263 |
| 4,260,293 | 4/1981 | Peterson | 405/219 |
| 4,316,426 | 2/1982 | Meeusen | 114/263 |
| 4,318,361 | 3/1982 | Sluys | 114/263 |
| 4,318,362 | 3/1982 | Jung | 114/266 |
| 4,353,320 | 10/1982 | Sluys | 114/267 |
| 4,355,431 | 10/1982 | Diefendahl et al. | 14/27 |
| 4,365,577 | 12/1982 | Heinrich | 114/267 |
| 4,365,914 | 12/1982 | Sluys | 405/221 |
| 4,418,634 | 12/1983 | Gerbus | 114/263 |
| 4,453,488 | 6/1984 | Watchorn | 114/266 |
| 4,538,939 | 9/1985 | Johnson | 405/205 |
| 4,543,903 | 10/1985 | Kramer | 114/263 |
| 4,559,891 | 12/1985 | Shorter, Jr. | 114/263 |
| 4,709,647 | 12/1987 | Rytand | 114/267 |
| 4,715,307 | 12/1987 | Thompson | 114/65 A |
| 4,887,654 | 12/1989 | Rytand | 114/267 |
| 4,930,184 | 6/1990 | Kristmanson | 16/273 |
| 4,940,021 | 7/1990 | Rytand | 114/267 |
| 4,962,716 | 10/1990 | Fransen et al. | 114/263 |
| 4,968,182 | 11/1990 | Westwell | 405/215 |
| 5,044,829 | 9/1991 | Hemminger | 405/203 |
| 5,125,355 | 6/1992 | Stranzinger | 114/263 |

FOREIGN PATENT DOCUMENTS

| | | |
|---|---|---|
| 800802 | 12/1968 | Canada . |
| 2055703 | 8/1979 | United Kingdom . |

*Primary Examiner*—Edwin L. Swinehart
*Attorney, Agent, or Firm*—Klarquist Sparkman Campbell Leigh & Whinston

[57] ABSTRACT

A floating dock that includes one or more box-like elements, each defined by a pair of spaced-apart, elongate, rigid beams between which extend top and bottom plates and end walls. The chamber so formed is partially filled with blocks of closed-cell EPS foam, the lower portion of the chamber being adapted to receive water from the body on which the float is positioned to act as ballast. Tie rods extend between the beams to retain them in engagement with the top and bottom plates.

2 Claims, 4 Drawing Sheets

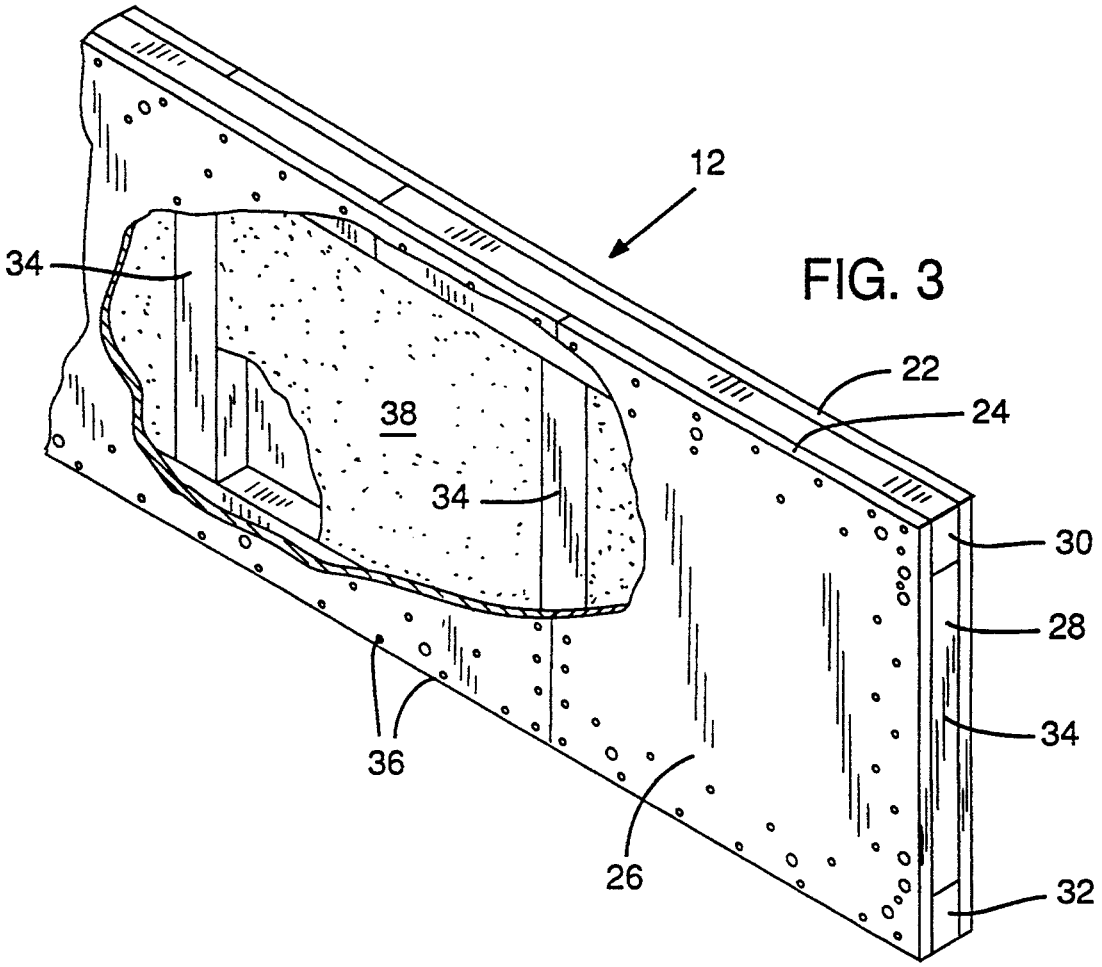
FIG. 3
FIG. 7
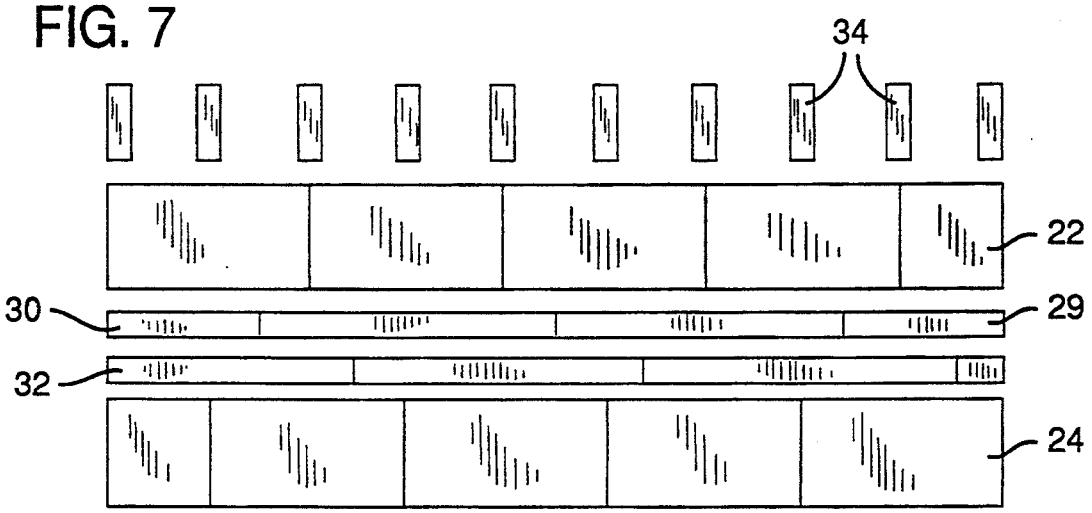

PANELIZED FLOAT SYSTEM

This invention concerns floating docks and, more particularly, is concerned with the provision of a dock that will not bend under vertical load and that will resist tipping against eccentric vertical loads imposed thereon.

BACKGROUND OF THE INVENTION

For many years, floating docks have been constructed utilizing expanded plastic foam to provide flotation. The foam, usually in the form of blocks, has generally been encased in relatively small protective containers, for example, as shown in my prior U.S. Pat. Nos. 4,709,647; 4,887,654; and 4,940,021. While docks constructed as shown in such patents have served admirably, there has been a need for a dock structure that has a greater load-carrying capacity, with longitudinally uniform distribution of loads without vertical deflection of the dock structure, and with greater lateral stability upon the application of eccentric loads.

It is an object of the present invention to provide a floating dock that will be stable against eccentric loading on its upper surface and highly resistant to movement under vertical loads such as imposed by wave action.

It is a further object of the invention to provide a dock that may be shipped knocked-down and erected easily at the job site, and which may be transported on trucks from the place of manufacture to the place of use.

Another object of the invention is to provide a dock with an understructure that eliminates bending the dock under a vertical load.

Still another object is to provide a dock structure that permits the provision of flotation foam cores positioned continuously end-to-end over the length of the dock structure.

A further object of the invention is to provide a floating wave attenuation device that will resist motion from wave action.

Still another object is to provide a dock structure that permits the use of water ballast, with provision to prevent sudden lateral shifting or migration of the water upon the imposition of an eccentric vertical load on the dock surface.

A further object of the invention is to provide a floating dock design utilizing a foam core for flotation that is essentially continuous side-to-side and end-to-end, enabling the reduction of the metacentric height of the dock over prior art designs.

Other objects and advantages of the invention will become apparent hereinafter.

BRIEF DESCRIPTION OF THE INVENTION

In accordance with an illustrated embodiment, the foregoing objects are achieved by a floating dock structure that includes a plurality of vertically deep, parallel, elongate, rigid beams that extend the length of the dock. A compression-resistant top plate or member extends between each adjacent pair of beams, and tie rods extend between the outermost beams to compress all the beams and top plates together. A bottom plate and end walls extend between each adjacent pair of beams so as to define an elongate chamber between each adjacent pair of beams. A plurality of tie bars extend between the beams adjacent their lower edges. Contained within each chamber is a series of blocks of conventional closed-cell EPS foam positioned in end-to-end relation and extending from end-to-end of the chamber. The blocks are of a predetermined lesser height than the height of the chambers so as to provide space beneath the foam, which may be filled with water to act as ballast for the dock.

BRIEF DESCRIPTION OF THE DRAWINGS

FIG. 3 is a perspective view of a beam, utilized in the dock at FIG. 1, partially broken away to show details of the construction thereof.

FIG. 7 is an exploded view of the components of the beam of FIG. 3.

DETAILED DESCRIPTION OF THE PREFERRED EMBODIMENT

Figure 1:
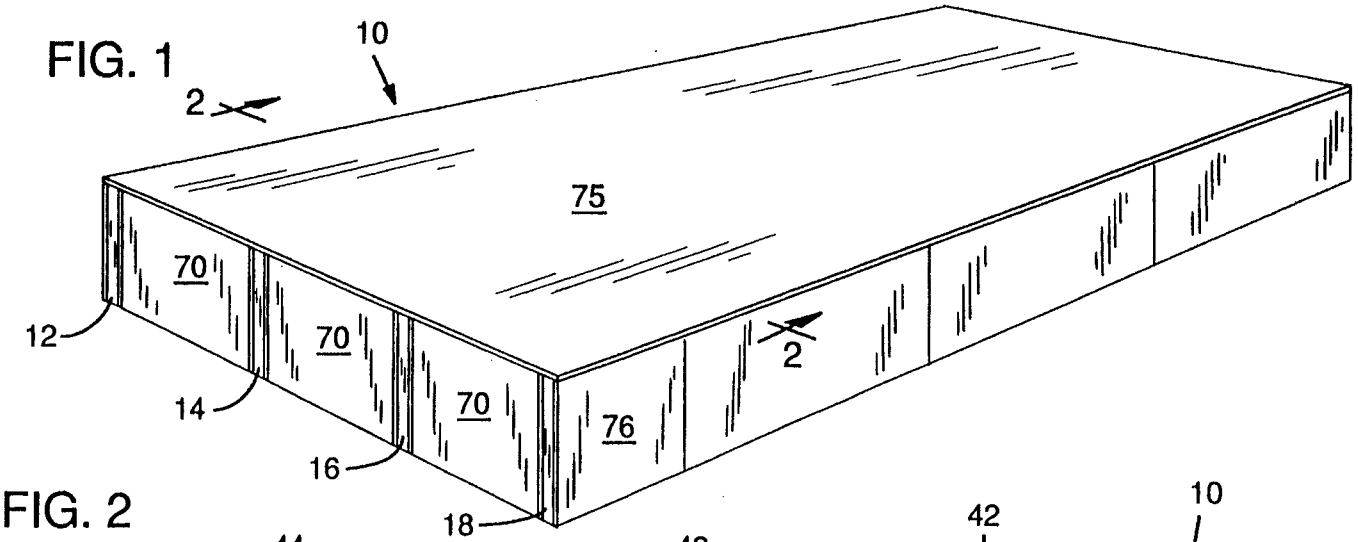
FIG. 1 is a perspective view, partially broken away, of a dock structure constructed in accordance with the invention.

Referring to the drawings, FIGS. 1 to 7 inclusive illustrate a basic dock structure constructed in accordance with the invention. It will be described with reference to particular materials of construction and dimensions to facilitate an understanding of the invention, but it is understood that changes in material and dimensions will be necessary to accommodate a dock to a particular environment or end use. The dock, indicated generally at 10, defines a platform that may be utilized as a dock, per se, to which vessels may be secured for the landing and embarking of cargo and passengers, or which may be used as a base for the support of living quarters, maritime service equipment and the like.

Dock 10 comprises a plurality, in this instance four, longitudinally extending parallel beams or hull plates 12, 14, 16 and 18, each of which is of substantially identical construction. Thus, the construction of the beams will be described with particular reference to beam 12, shown in FIG. 3. The beam 12 comprises a pair of opposite, structurally strong side panels 22, 24 that may comprise a series of 4′×8′ exterior grade ¾-inch plywood sheets 26 secured at the opposite sides of a frame 28. The frame consists of a plurality of 4″×6″ timbers 29 arranged to form a rectangular structure, including a top frame member 30, a bottom frame member 32, and a plurality of supporting posts 34 extending between the top and the bottom frame members on 4′ centers. The plywood sheets 26 are preferably offset on the opposite sides of the beam 12, as indicated in FIG. 7, to enhance the rigidity of the beam 12. The joints between the timbers making up the top and the bottom frame member preferably are offset vertically for the same reason. The plywood sheets 26 may be secured to the frame members and posts by suitable fasteners, such as by stainless steel nails indicated at 36.

The interior cavities of the frame 28 are preferably filled with blocks 38 of conventional closed-cell EPS foam.

Figure 2:
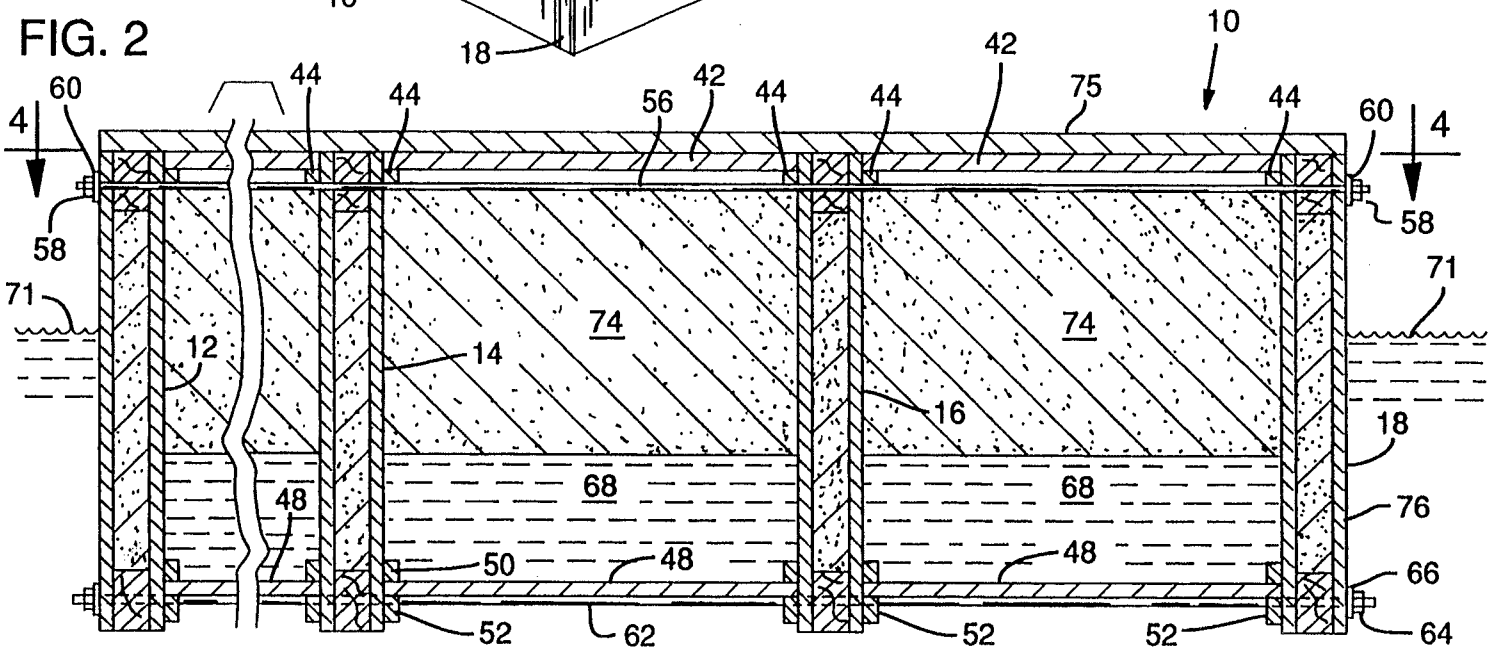
FIG. 2 is a cross-sectional view taken along line 2—2 of FIG. 1.
Figure 4:
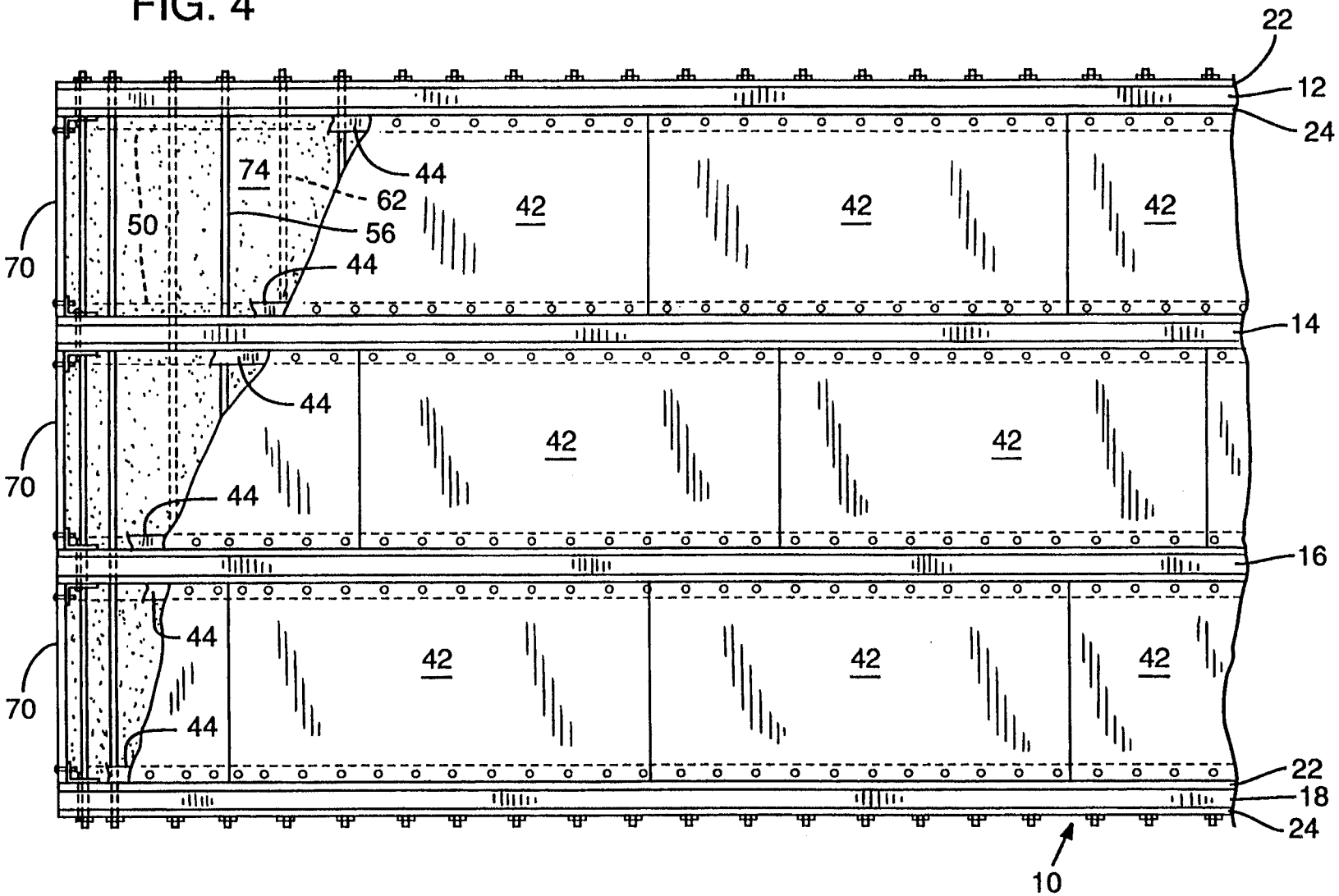
FIG. 4 is a fragmentary plan view of the dock of FIG. 1 with the deck removed as it would appear in a view taken along line 4—4 of FIG. 2.

Referring now more particularly to FIGS. 2 and 4, extending between adjacent beams 12–18 adjacent the top edges thereof are a series of top compression plates 42 that seat upon ledger strips 44 nailed or otherwise suitably secured to the beam side panels 22, 24 at an elevation such that the top surface of each plate 42 is substantially flush with the top edges of the beams. The plates 42 are of a suitable compression resistant construction and may comprise 1⅛" exterior grade plywood. FIG. 4 illustrates how the plates 42 preferably are offset relative to those in the adjacent rows so that the joints between plates in adjacent rows are offset, again to increase the structural rigidity of the dock 10. Also extending between adjacent beams 12–18 adjacent to but somewhat above the bottom edges thereof are a plurality of compression or diaphragm plates 48 that seat between and are nailed to upper and lower ledger strips 50, 52, nailed or otherwise suitably secured to the appropriate side surfaces of the beams 12–18, as best shown in FIG. 2.

Extending through the beams 12–18 just beneath the top compression plates 42 are a plurality of tie rods 56 that by means of nuts 58 and washers 60 effect clamping of the beams 12–18 and plates 42 substantially rigidly together. Also extending through the beams 12–18 just beneath the bottom compression plates 48 are a plurality of lower tie rods 62 provided with nuts 64 and washers 66 to effect clamping of the beams 12–18 and compression plates 48. The tie rods 56 and 62 extend through cooperative openings drilled through the beams 12–18.

Figure 5:
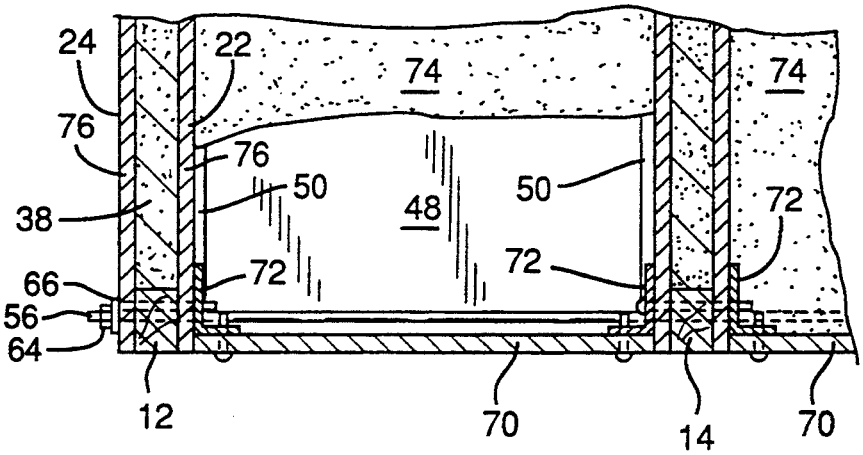
FIG. 5 is a view taken along line 5—5 of FIG. 6, showing details of the construction.
Figure 6:
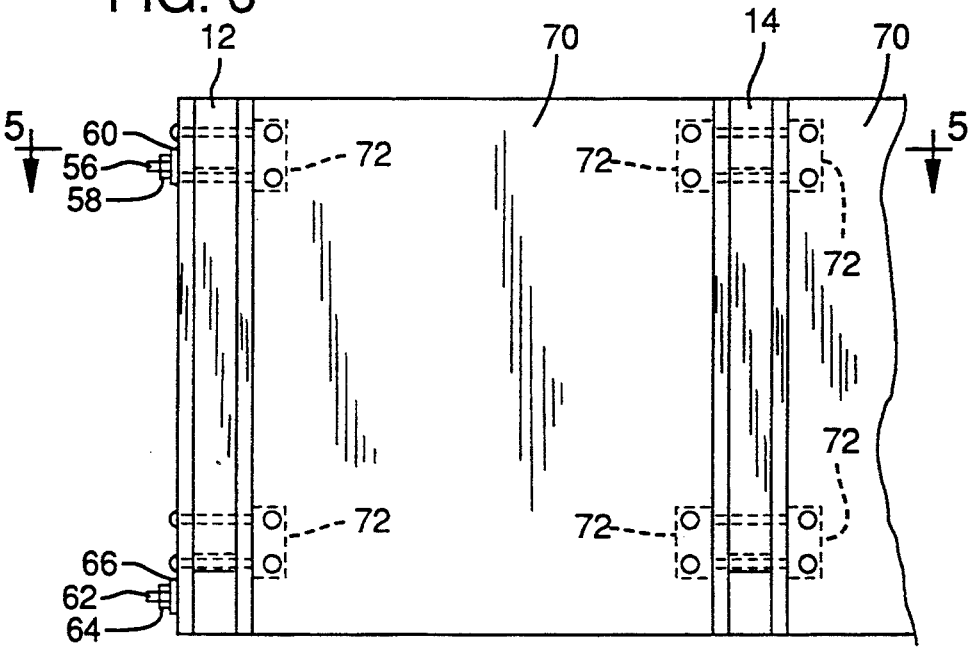
FIG. 6 is a fragmentary end elevation of the dock at FIG. 1, showing further details of the construction thereof.

The ends of the chambers 68 that are defined between the beams 12–18 and compression plates 42, 48 are closed by opposite end panels 70, which are secured to the appropriate ends of the beams 12–18 by bolting the same to brackets 72, which are in turn bolted to the beams 12–18, as indicated in FIGS. 5 and 6.

Positioned within the chambers 68 mentioned above are blocks 74 of a conventional closed-cell EPS foam. The blocks 74 are positioned below the upper tie rods 56 and are arranged end-to-end throughout the length of each of the chambers. The depth of the foam positioned within the chambers 68 is dependent upon the height it is desired that the loaded dock float above the surface of the water, which is indicated at 71. In the present instance, the foam is shown as occupying the chambers to about ⅔ of the volume of the chambers.

The depth of the beams 12–18 and amount of foam volume also will be selected upon the anticipated loading. Preferably the weight of the water within the chambers 68 should be approximately equal to the sum of the following:

(a) the dry deadload of the dock itself;
(b) the superimposed structure;
(c) the liveload of occupants, workers and equipment or the like; and
(d) the anticipated windload that could be imposed against the superimposed structure.

In addition, the ballast weight of the water in a side chamber 68 should more than equal any anticipated eccentric load application to the opposite side of the float platform.

Over the tops of the upper compression plates 42 and the beams 12–18 may be laid decking, indicated at 74, of any suitable type.

The plates 48 may also be made of 1⅛" exterior grade plywood, but it is not critical that the bottoms of the spaces between the beams be completely closed by a compression resistant means. A principal function of the plates 48 is to provide a water flow barrier so that water will be retained in the space between the beams in the event of application of an eccentric load that would tend to tip the dock. Thus, any type of substantially water impervious barrier or closure means may be used in place of the plates 42 that has the strength to support the load of the water column above the barrier as the dock portion above it elevates as a result of tipping of the dock. For example, a strong, glass or plastic fiber filter fabric, for example, a geotextile, could be used to close the space between the bottom edges of the beams 12–18. In this event, compression-resistant means in the form of rods or beams would be positioned at appropriate intervals between the beams 12–18.

Upon positioning the dock 10 in a body of water, water will seep through the openings between the beams 12–18 and lower compression plates 48 so as to fill the chambers to the point of equilibrium of the dock in the water, and at which point the water level in the chambers will be at the water level 71. The foam 74 will, of course, permit only a minimum amount of water to fill the interstices thereof, usually about 3 percent by volume.

The dock, as illustrated, may be utilized as a floating dock to which vessels may be tied for the ingress or egress of passengers, or may be utilized for supporting a diversity of things, such as residences, sanitary facilities, or other equipment that is to be utilized in a maritime environment. The beams 12–18, by the nature of their construction, act as a deep truss and resist bending under a vertical load throughout their entire length. The water contained within the chambers acts as a passive ballast, so that tipping of the dock is substantially negligible upon the positioning of an eccentric load on the deck. The continuous longitudinal panels 14, 16 effectively chamber the water ballast to prevent sudden lateral shifting or migration of the water ballast medium in the event of the application of an eccentric load to one edge or end of the dock structure, thereby stabilizing the dock against such tipping. The fact that the beams 12–18 are foam filled is also advantageous in helping to effect a substantially continuous side-to-side flotation, providing the greatest possible flotation footprint. This reduces the metacentric height of the dock.

The dock of the invention also has a very low dead weight in relation to its strength, giving it greater load-carrying capacity, with longitudinally uniform distribution of loads with minimum vertical deflection.

A plurality of docks may also be arranged in end-to-end fashion and used as a wave attenuating device, either separated or flexibly joined as by hinges. Because of the load of the water ballast, the docks resist vertical movement against vertical loads imposed by wave action.

As will be apparent, the beams 12–18 may be preassembled off site, and the other elements making up the dock may be similarly prepared off site and easily shipped by truck or other conveyance to the site where the dock is to be used, and there can easily be assembled.

In an alternative design, the foam-filled core beams 12–18 may be replaced with laminated wooden beams. The resulting dock will have the same substantial rigidity as the preferred embodiment, but will possess greater weight and will have a lesser flotation footprint.

Also, while a dock is preferably provided with continuous beam-defined chambers along its opposite sides or ends so as to provide maximum stability to the dock, a central portion of the dock need not in some instances require a flotation chamber therebeneath. For example, the chamber defined between the beams 14 and 16 in the illustrated embodiment could be interrupted or eliminated entirely, and a tank or well positioned between the beams 14, 16.

Having illustrated and described the preferred embodiments of the invention, it should be apparent to those skilled in the art that the invention permits a modification in arrangement and detail. I claim all such modifications that come within the purview and scope of the appended claims.

I claim:

1. A floating dock comprising:

a rectangular, box-like float element having opposite elongate sidewalls defined by a pair of elongate, substantially rigid beams extending substantially the length of the dock, compression-resistant means extending between said sidewalls adjacent the bottom edges of said beams, a substantially watertight wall extending between the bottom edges of said beams, and a compression-resistant top plate extending between said sidewalls the length thereof adjacent the top edges of said beams, a pair of end walls positioned one adjacent each of the opposite ends of said side walls, and extending therebetween;

a first set of compression means extending through said beams beneath said top plate and acting on said beams such that said beams are engaged snugly with said top plate and said end walls, a second set of compression means extending through said beams adjacent said bottom wall and acting on said beams such that said beams are engaged snugly with said compression-resistant means and said end walls whereby said float element provides a hollow, substantially stable box beam defining a chamber;

a buoyant material partially filling a predetermined upper portion of said chamber and providing a predetermined space therebeneath into which water may flow to provide a ballast;

said walls defining a means for limited ingress and egress of water into the interior of said float element when the same is positioned in a body of water.

2. A floating dock as set forth in claim 1, comprising a plurality of said float elements.

* * * * *